US005774909A

United States Patent [19]

Stable

[11] Patent Number: 5,774,909

[45] Date of Patent: Jul. 7, 1998

[54] FOOT BATH

[76] Inventor: Michael T. Stable, Bolton Manor Farm, Cumbria, Great Britain, LA12 OPX

[21] Appl. No.: 747,934

[22] Filed: Nov. 12, 1996

Related U.S. Application Data

[63] Continuation of Ser. No. 564,897, Nov. 29, 1995, abandoned, which is a continuation of Ser. No. 232,252, filed as PCT/GB92/02040 Nov. 4, 1992, abandoned.

[30] Foreign Application Priority Data

Nov. 5, 1991 [GB] United Kingdom ..... 9123417

[51] Int. Cl.[6] ..... A41K 3/022

[52] U.S. Cl. ..... 4/622; 119/158; 604/293

[58] Field of Search ..... 4/504, 580–583, 4/622; 604/293; 119/158, 161, 170

[56] References Cited

U.S. PATENT DOCUMENTS

| | | | |
|---|---|---|---|
| Re. 30,424 | 11/1980 | Heldenbrand | 119/170 |
| 1,965,558 | 7/1934 | Weirch | 4/622 |
| 1,992,648 | 2/1935 | Browne | 604/293 |
| 2,080,601 | 5/1937 | Cappuccio | 4/580 |
| 2,956,565 | 10/1960 | Anderson | 607/86 |
| 3,045,254 | 7/1962 | Cook et al. | 4/580 |

FOREIGN PATENT DOCUMENTS

| | | | |
|---|---|---|---|
| 0670199 | 10/1964 | Italy | 604/293 |
| 0636512 | 6/1983 | Switzerland | 4/583 |

*Primary Examiner*—Charles E. Phillips
*Attorney, Agent, or Firm*—Foley & Lardner

[57] ABSTRACT

The invention proposes a foot bath for applying a treatment liquid to feet and which facilitates the use of a smaller quality of treatment liquid. The foot bath comprises a deformable liquid collection surface (22) bounded by a rim to retain the liquid therewithin. More particularly the deformable liquid collection surface comprises a sheet of flexible impervious material disposed over a resilient supporting layer (20). The action for an animal walking on the surface (22) causes a well to be formed in the liquid collection surface into which the treatment liquid flows. The depth of the supporting layer determines the depth of the well.

15 Claims, 1 Drawing Sheet

FOOT BATH

Figure 1:
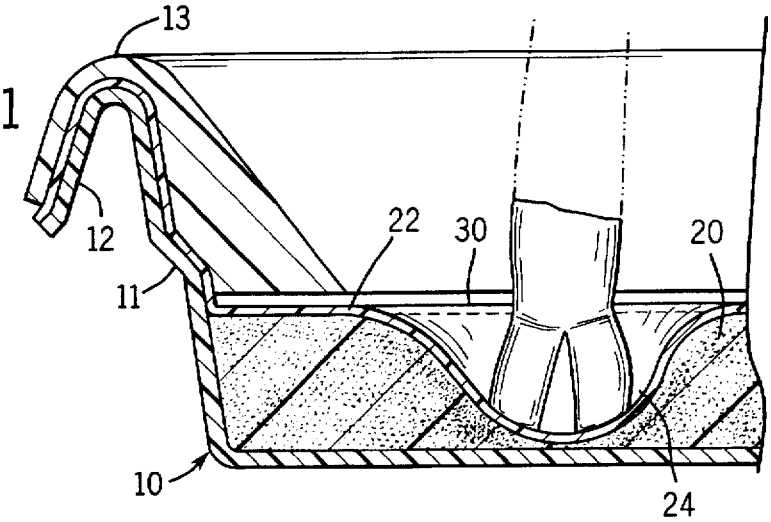

This is a continuation of application Ser. No. 08/564,897 filed Nov. 29, 1995, abandoned, which is a continuation of Ser. No. 08/232,252, filed Sep. 19, 1994, abandoned, which is a 371 of PCT/GB92/02040 filed Nov. 4, 1992.

DESCRIPTION

This invention relates to a foot bath for use in connection with the treatment of cattle and/or other livestock, or otherwise.

Cattle are prone to digital dermatitis, a complaint which shows itself above the horn of the foot (coronet). Conventional methods of treatment include spraying individual affected animals with oxytetracycline and/or gentian violet. Although this will generally cure the treated animal it is likely that other members of a herd are also suffering unnoticed. A solution to this would be to provide a foot bath and so treat the whole herd. However the chemicals required are expensive and so it would prove costly to fill a foot bath to a sufficient depth to ensure adequate treatment, and thereafter keep it topped up to that depth of fill.

It is an aim of the present invention to provide a solution to this problem.

According to the present invention a foot bath comprises a deformable liquid collection surface bounded by an upstanding peripheral rim for retention of a treatment liquid therewithin, and wherein the deformable liquid collection surface is deformed when subjected to load, ie. when subjected to the weight of a hoof/foot, so as to form a localised well around the hoof/foot into which well the treatment liquid flows.

Thus it will be understood that the action of the animal walking through the foot bath generates depressions in the liquid collection surface and that this is advantageous in that it allows the use of a much lower quantity of treatment liquid. Accordingly the invention provides a method of treating animals' feet with a treatment liquid in which the action of the animals walking over a deformable collection surface generates local wells for the treatment liquid.

The depth of the resulting well may be tailored to suit the particular animal and/or condition being treated.

The deformable liquid collection surface may be used with the standard tray-like foot baths or may be constructed as a self-contained unit. In on embodiment the deformable liquid collection surface will conveniently be adapted to fit a standard flat-based foot bath which provides a support therefor. A typical foot bath for these purposes is a Paxton foot bath which has lipped edging.

The deformable liquid collection surface may be a stretched out flexible elastic material spaced above a support surface which limits the depth of the well according to the spacing. However in a preferred embodiment a deformable liquid collection surface comprises an impervious sheet of material supported by a layer of flexible material, such as foamed rubber or plastics. The impervious material may be an elastic material to allow some stretch.

The flexible layer may be received within the tray-like configuration of a standard foot bath and the impervious layer may lay loosely over an upper surface of the flexible layer and extend to form a seal with a rim of the foot bath to ensure liquid is kept from said flexible layer. In an alternative embodiment, the layer of flexible material may be encased by the impervious material and the arrangement may be configured to incorporate the upstanding peripheral rim thereby forming a self-contained tray-like unit.

It is convenient to provide protection from animal hooves at extreme portions of the flexible layer ie. adjacent to the peripheral rim of the foot bath, for example by use of a cover. Preferably a cover overlays in part the flexible layer and the impervious layer, and extends inwards from sidewalls of the foot bath over an internal portion of the foot bath. Conveniently the inward extension of the cover is of a length equivalent to the depth of flexible material. The cover preferably has walls sloping inwards to help guide an animal's foot away from edge portions of the foot bath. Another method of guiding hooves inwards whilst protecting the edge portions of the impervious and flexible layers would be to allow a greater thickness of flexible layer at or near its edge so as to form upstanding side portions. A cover may be required as additional protection.

Where the impervious layer covers the flexible layer in part only (for example overlying its upper surface), said impervious layer preferably extends up the peripheral rim of the foot bath and outwards over any edging of the foot bath. Also preferably said impervious layer is held in place by fixing means. Fixing means may be inside the foot bath eg. tubing around the internal dimension of the foot bath. Alternatively and/or additionally the impervious layer may be fixed externally to the foot bath eg. by a draw string or by cooperable means on both the impervious layer and the foot bath such as hooks and eyes, or fixing means engageable with a lip of the foot bath.

Conveniently, the resilient material is foamed rubber or plastics with the impervious layer being formed from plastics sheeting. The depth of the foamed plastics material can be varied to suit different breeds and ages of animals. For example, for adult cattle 50 mm foam would be suitable, for young cattle foam of 25 mm thickness will be sufficient and for sheep a 12 mm thickness would be suitable.

In the embodiment of the invention a standard Paxton plastic foot bath is used to hold a foam rubber layer and plastics oversheet. Furthermore the foot bath is provided with a cover around the sides of the foot bath and extending inwards over a portion of the base of the foot bath to protect the plastic sheeting at its weaker parts, ie. those abutting the sides of the foot bath.

Another embodiment comprises a peripheral frame constructed as a holder to receive the peripheral edges of the flexible support layer (eg. foamed plastics) to hold same inclined upwardly in order to form a catchment basin. The deformable impervious layer covers the flexible support layer and preferably as an all embracing covering to all side and faces.

Of course a more permanent construction of footbath can be provided by forming a basin out of concrete with a base sloping up to the periphery to define the upstanding peripheral rim and in which is placed the deformable liquid collection surface may comprise a resilient foamed plastics. Less expensively, the basin may be provided by a simple hollow in the ground. Again the support for the deformable liquid collection surface may comprise a resistent foamed plastics which may be completely encased by the impervious layer or that may overlie the foamed plastics. The basin plus the aforedescribed deformable liquid collection surface will produce a footbath which retains the treatment liquid with in a peripheral lip.

Of course, it is possible to envisage applications of the invention for use other than by animals. For example, it could find application in swimming baths or other situations where the foot or footwear is required to be subject to treatment by chemicals.

Whilst the preferred flexible support layer is formed by a foamed plastics layer, it is possible to use a fluid. For example, the impervious layer may be applied over water. Alternatively the impervious layer may be formed as a sealed flexible container filled with liquid, eg. water, or inflated with air.

Figure 2:
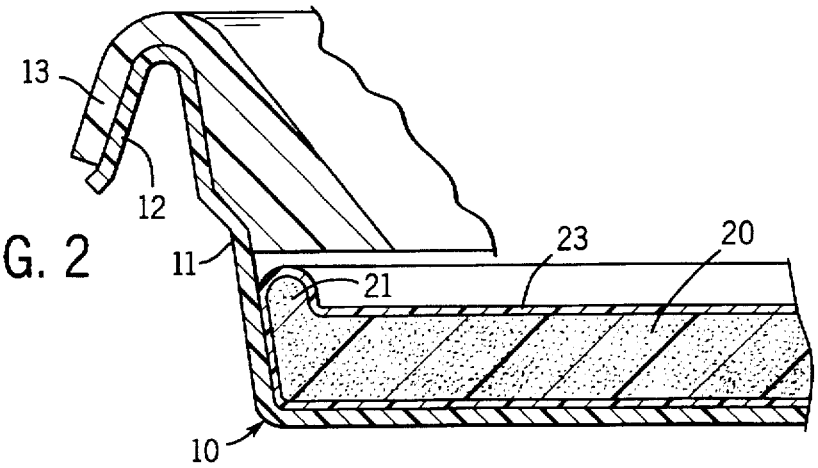
Figure 3:
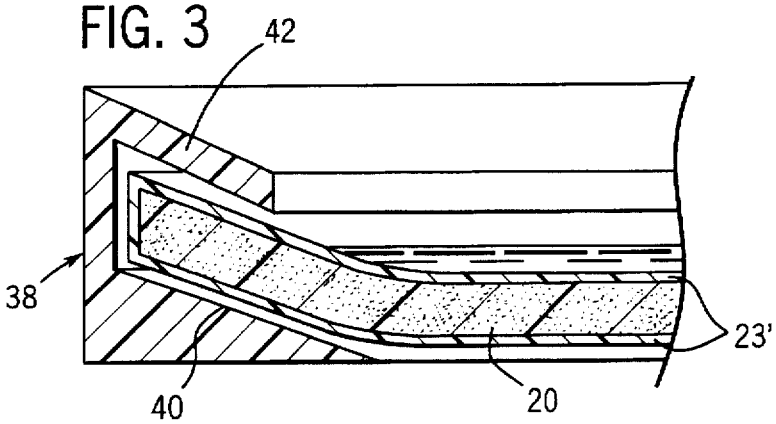
Figure 4:
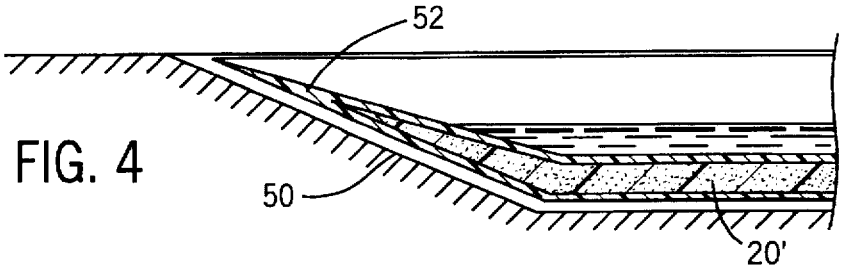

The present invention will now be described further by way of example only, with reference to the accompanying drawings, in which:

FIG. 1 is a partial sectional view of the foot bath according to a first embodiment of the invention, FIG. 2 is a partial sectional view of a second embodiment of the invention, FIG. 3 is a section through part of a further embodiment, and FIG. 4 is a section of part of a yet further embodiment.

In a first embodiment of the invention of Paxton preformed plastics foot bath 10 has sidewalls 11 and lipped edging 12. It is provided with a resilient foamed rubber/plastics mat 20 to cover its base. An impervious sheet 22 (for example of plastics material preferably exhibiting some elasticity) overlies said mat and extends beyond said mat up the sidewalls 11 of the foot bath and over the lipped edging 12. In the exemplary embodiment illustrated, sheet 22 acts as a support having a surface which supports a liquid layer of treatment solution.

A cover 13 sits upon the plastics sheet 22, at the lipped edging 12 and acts to hold the sheet in place as well as protecting the sheet from damage. It extends around the edge of the footbath and inwards to cover vulnerable edge portions of the plastics sheet 22. The cover 13 is sloped to guide hooves inwards and to avoid a stumbling edge.

In the treatment of digital dermatitis a liquid layer of treatment solution S of oxytetracycline and/or gentian violet is placed in the foot bath in much smaller quantities that usual. The liquid 30 lies on top of the impermeable plastics layer 22. As an animal hoof bears down on the plastics sheet 22 and the mat 20, a depression 24 is formed by compression of the mat 20 and liquid 30 lying on top of the plastics sheet 22 flows into the depression 24 providing a depth of liquid sufficient to treat a foot.

In a second embodiment of the invention the foot bath 10 is again provided with a foamed rubber or plastics mat 20, which mat is provided with upstanding side portions 21 around its perimeter. The mat is covered entirely by an impermeable plastics layer 23. In this way treatment liquid is prevented from entering the foam rubber. A cover 13 is preferred to give further protection from animal hooves to edge portions of both the mat 20 and its protective layer 23. Where the mat is used within a tray-like foot bath, the cover prevents the mat being deformed at the edge and thereby avoids liquid from escaping and flowing under the mat.

Referring now to FIG. 3, here a foamed rubber or plastics mat 20' is covered entirely with a flexible impermeable plastics layer 23'. Instead of the mat having the preformed lip 21 of FIG. 2 it is a simple resilient slab. A peripheral liquid retention rim is provided by fitting retention means 38 to the peripheral edges of the mat. The retention means may comprise a single moulding or two or more parts which together define a peripheral framework. The retention means has an inclined surface 40 which serves to deflect the edges of mat 20' upwardly so that liquid is retained therewithin. In the illustrated embodiment the retention means has an upper inwardly directed downwardly inclined flange 42. The flange may bear on the surface of the mat for retention purposes. The embodiment functions in the manner described previously.

Referring now to FIG. 4, here we illustrate how a hollow 50 may be formed in the ground with a base and inclined side walls (they may be more steeply angled or even vertical) so as to define a trough or basin. The foamed rubber or plastics mat 20' of FIG. 3 with impervious cover 23' may be utilised in such a trough, although advantageously the mat tapers to the peripheral edges. The side walls serve to deflect the mat to provide the fluid retaining rim 52.

Alternatively, liquid such as water may be used to partially fill the trough and an impervious flexible membrane layered over the liquid and up the inclined sides. The liquid will act as the deformable support for the membrane.

I claim:

1. An apparatus for treating a surface of a foot with a treatment substance, the apparatus comprising:

a floor;

at least one sidewall having an upstanding peripheral rim and extending upward from the floor to define a basin;

a support defining an impervious deformable support surface spaced from the floor by a distance such that the impervious deformable surface forms a localized well about the foot when subjected to loading by the foot, and such that the localized well has a depth sufficient for containing the treatment substance in contact with the surface of the foot to be treated; and a flange extending inwardly from the peripheral rim to partially overlie the support surface, wherein the flange slopes inwardly and downwardly from said at least one sidewall.

2. The apparatus of claim 1 including:

resiliently deformable layer between the floor and the support surface.

3. The apparatus of claim 2, wherein the layer includes a resilient layer of foamed plastics.

4. The apparatus of claim 2, wherein the layer has an upstanding peripheral edge.

5. The apparatus of claim 2, wherein the support comprises a flexible impervious sheet which envelopes the layer.

6. The apparatus of claim 2, wherein the support includes:

a flexible impervious sheet defining the support surface and overlying and supported by the layer, wherein the flexible impervious sheet extends up the upstanding peripheral rim.

7. The apparatus of claim 6 including:

means for retaining the sheet in engagement with the upstanding peripheral rim.

8. The apparatus of claim 7 wherein the means for retaining includes:

a peripheral frame having a channel section fitting over the rim to capture the sheet between the frame and the rim.

9. A foot bath comprising an impervious deformable liquid collection surface bounded by an upstanding peripheral rim for retention of a liquid on the impervious deformable liquid collection surface within the upstanding peripheral rim, wherein the foot bath includes a resilient supporting layer; and a flexible and impervious sheet overlying and supported by the supporting layer, the supporting layer defining the collection surface, wherein the flexible impervious sheet extends up the upstanding peripheral rim, wherein the foot bath includes a peripheral frame having a channel section fitting over the rim to capture the sheet between the frame and the rim, and wherein the deformable liquid collection surface is deformed when subjected to a load of a hoof or foot thereon so as to form a localized well around the hoof/foot into which well the treatment liquid flows so providing a sufficient depth of liquid for treatment.

10. The foot bath of claim 7 wherein the supporting layer includes a resilient layer of foamed plastics.

11. The foot bath of claim 9 including:

a flange extending inwardly from the peripheral rim to partially overlie the liquid collection surface.

12. The foot bath of claim 11 wherein the flange slopes inwardly and downwardly from the peripheral rim.

13. An apparatus for treating a surface of a foot with a treatment substance, the apparatus comprising:

a floor;

at least one sidewall having an upstanding peripheral rim and extending upward form the floor to define a basin;

a resiliently deformable supporting layer with in the basin;

a flexible impervious sheet overlying the supporting layer and extending over the peripheral rim, wherein the flexible impervious sheet defines an impervious deformable support surface spaced from the floor by a distance such that the impervious deformable support surface forms a localized well about the foot when subjected to loading by the foot, and such that the localized well has a depth sufficient for containing the treatment substance in contact with the surface of the foot to be treated; and a peripheral frame having a channel section fitting over the rim to capture the sheet beteen the frame and the rim.

14. The apparatus of claim 13 including:

a flange extending inwardly from the frame to partially overlie the support surface.

15. The apparatus of claim 14 wherein the flange slopes inwardly and downwardly from said at least one sidewall.

* * * * *